US009068720B2

(12) United States Patent
Mangus

(10) Patent No.: US 9,068,720 B2
(45) Date of Patent: Jun. 30, 2015

(54) LIGHTED WORK MAT

(71) Applicant: Larry P. Mangus, East Rochester, OH (US)

(72) Inventor: Larry P. Mangus, East Rochester, OH (US)

( * ) Notice: Subject to any disclaimer, the term of this patent is extended or adjusted under 35 U.S.C. 154(b) by 157 days.

(21) Appl. No.: 13/785,750

(22) Filed: Mar. 5, 2013

(65) Prior Publication Data

US 2014/0254158 A1 Sep. 11, 2014

(51) Int. Cl.

| | |
|---|---|
| ***F21V 33/00*** | (2006.01) |
| ***F21V 15/01*** | (2006.01) |
| *F21W 131/10* | (2006.01) |
| *F21W 131/40* | (2006.01) |
| *F21Y 101/02* | (2006.01) |
| *F21Y 105/00* | (2006.01) |

(52) U.S. Cl.

CPC ..... *F21V 15/012* (2013.01); *F21V 15/01* (2013.01); *F21W 2131/1005* (2013.01); *F21W 2131/40* (2013.01); *F21Y 2101/02* (2013.01); *F21Y 2105/001* (2013.01)

(58) Field of Classification Search

USPC ..... 362/153, 153.1, 253, 234

See application file for complete search history.

(56) References Cited

U.S. PATENT DOCUMENTS

| | | | | |
|---|---|---|---|---|
| 5,848,830 | A | 12/1998 | Castle et al. | |
| 6,481,877 | B1 | 11/2002 | Bello, Jr. | |
| 7,407,307 | B2 | 8/2008 | Hiratsuka | |
| 8,206,002 | B1 * | 6/2012 | Olson | 362/153.1 |
| 2008/0141571 | A1 | 6/2008 | Kottwitz | |
| 2008/0244944 | A1 | 10/2008 | Nall et al. | |
| 2011/0310595 | A1 * | 12/2011 | Hardesty | 362/153 |

OTHER PUBLICATIONS www.sears.com/shc/s/p_10153_12605_SPM5112156601P?sid=IDx20070921x00003a&ci_src=14110944&ci_sku=SPM5112156601, EagleLight LED Grow Light Panel 14watt Hydroponic 225 bulbs/Red, Blue 110V, 2 pages, document is undated but printed from the pertinent website on Jan. 3, 2012.

www.amazon.com/LED-Wholesalers-2501MX-Square-Light/dp/B001MVYZA, LED Wholesalers 2501MX Blue/Red 225 LED 13.8 Watt Square Grow Light Panel 110 Volt, 2 pages, document is undated but printed from the pertinent website on Jan. 3, 2012.

* cited by examiner

*Primary Examiner* — Jospeh L Williams

(74) *Attorney, Agent, or Firm* — Sand & Sebolt

(57) ABSTRACT

A modular work mat for a vehicle including a base, a plurality of light sources embedded in the base, wiring connecting the light sources; wherein the wiring is operatively connectable to a power source. The light sources preferably are LEDs. The base includes a first layer of a first material and a second layer of a second material and the LEDs are embedded between the first and second layers. The mat is connected via a power cord to a power supply and when the power supply is activated, the LEDs emit light through the first layer of the base. The work mat is placed on a surface so that the emitted light is able to illuminate a portion of the undercarriage or the entire undercarriage. The mat may be positioned beneath a portion of the vehicle's undercarriage or the vehicle may be driven onto the mat.

17 Claims, 8 Drawing Sheets

LIGHTED WORK MAT

BACKGROUND OF THE INVENTION

1. Technical Field

This invention relates generally to work mats. Specifically, this invention is directed to work mat having a base in which a plurality of LED's are embedded, and where the mat is positionable on a surface beneath the undercarriage of a vehicle; and the LEDs are activate to illuminate the vehicle's undercarriage from below.

2. Background Information

Mechanics and people skilled in personally working on their own vehicles require adequate lighting to see clearly when they are working on a vehicle. If the mechanic is working on a vehicle's engine, it is possible to position a light source in a location that enables the mechanic to see. That light source may simply be overhead lights in the garage, a flashlight of some type, or a work light that is secured somehow onto the underside of the vehicle's hood or adjacent the part of the engine the mechanic is working on.

If, however, the mechanic is working on the vehicle's undercarriage and does not have access to a lighted work pit, the mechanic may need to lie on the ground, slide under the vehicle and use a flashlight to see. This, of course, causes issues because of the need to hold the flashlight. Additionally the light source is a point light source and thus casts shadows which interfere with the mechanic's ability to work properly.

There is therefore a need in the art for an improved light source for providing illumination for locations such as under the undercarriage of a vehicle.

BRIEF SUMMARY OF THE INVENTION

The device of the present invention comprises a modular lighted work mat made up one or more substantially flat modular panels. Each panel includes a plurality of light-emitting diodes (LEDs) embedded in a base and spaced at intervals from each other. The lighted work mat is provided with wiring to connect the LEDs and the wiring is operatively connected to a power source. A switch is provided on the work mat to activate and deactivate the LEDs. Multiple lighted work mat panels are joined together along their edges by suitable fasteners so that the mat may be made to a desired size so as to provide lighting for the entire underside of a vehicle. Panels are added or removed to adjust the size of the lighted work mat for different vehicles. A ramp may be connected to one edge of the lighted work mat to enable a mechanic's creeper to roll onto and off of an upper surface of the lighted work mat.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
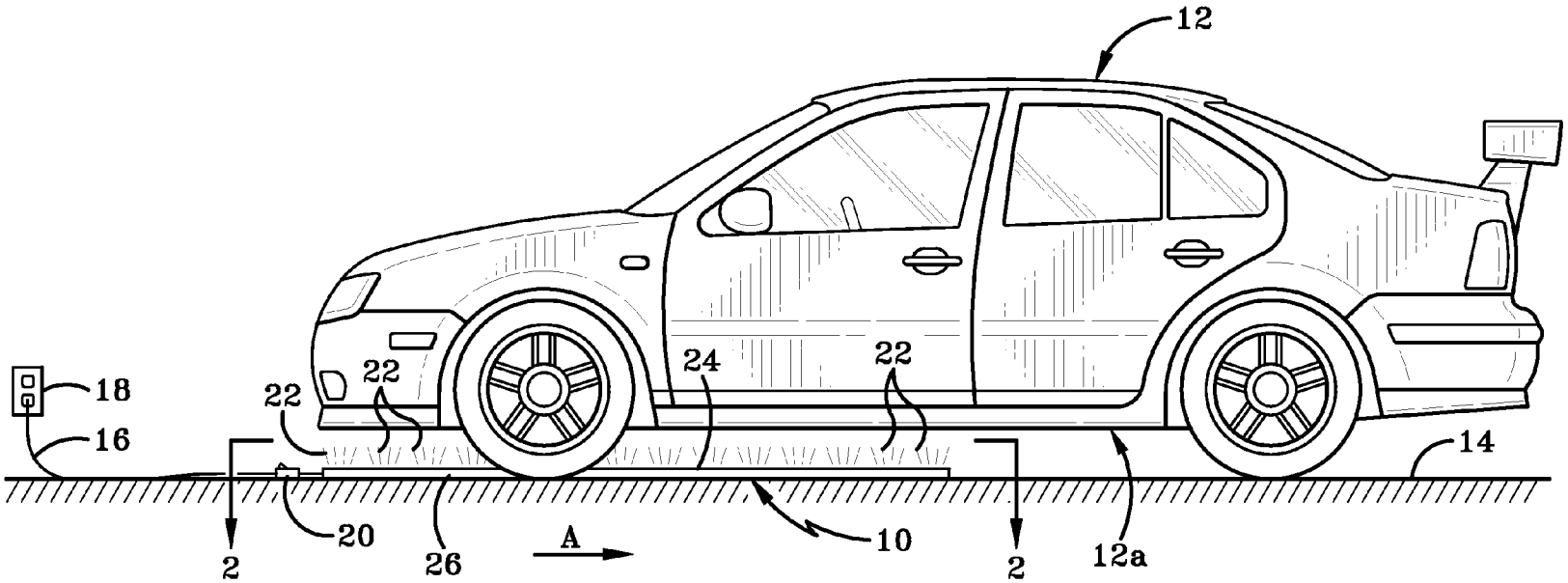
FIG. 1 is a side view of an automobile showing a lighted work mat in accordance with the present invention resting on a surface beneath the automobile's undercarriage.

Referring to FIGS. 1-5, there is shown a lighted work mat in accordance with the present invention, generally indicated at 10. Work mat 10 is designed for use during repair or maintenance of a vehicle 12. Most particularly, work mat 10 is configured to be positioned on a surface 14 upon which vehicle 12 stands and beneath the vehicle's undercarriage 12*a*. Work mat 10 includes wiring 15 (FIG. 4) which is operatively connected via a power cord 16 to a remote power source, such as an AC outlet 18. (It will be understood that the power source may take other forms such as a battery, without departing from the scope of the invention.) A switch 20 is provided to activate and/or deactivate work mat 10 so that it emits light 22 (FIG. 1) or does not emit light (not shown).

Referring now to FIGS. 2-5, work mat 10 includes a base. The base includes at least a first layer 24 (FIG. 4) into which a plurality of light sources and associated wiring are embedded, as will be described hereafter. In the preferred embodiment the base also includes a second layer 26 which is disposed vertically beneath first layer 24. It will be understood that the base may include more than just first and second layers 24, 26 without departing from the scope of the present invention.

Figure 4:
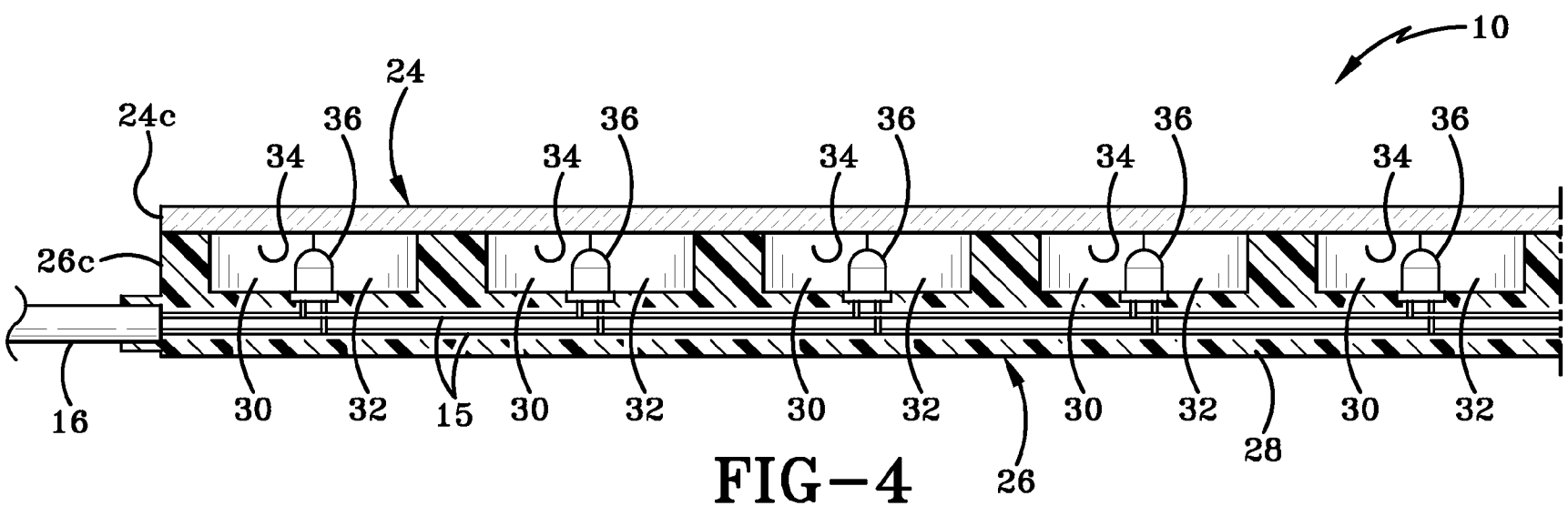
FIG. 4 is a cross-sectional side view of the lighted work mat taken along line 4-4 of FIG. 2.
Figure 5:
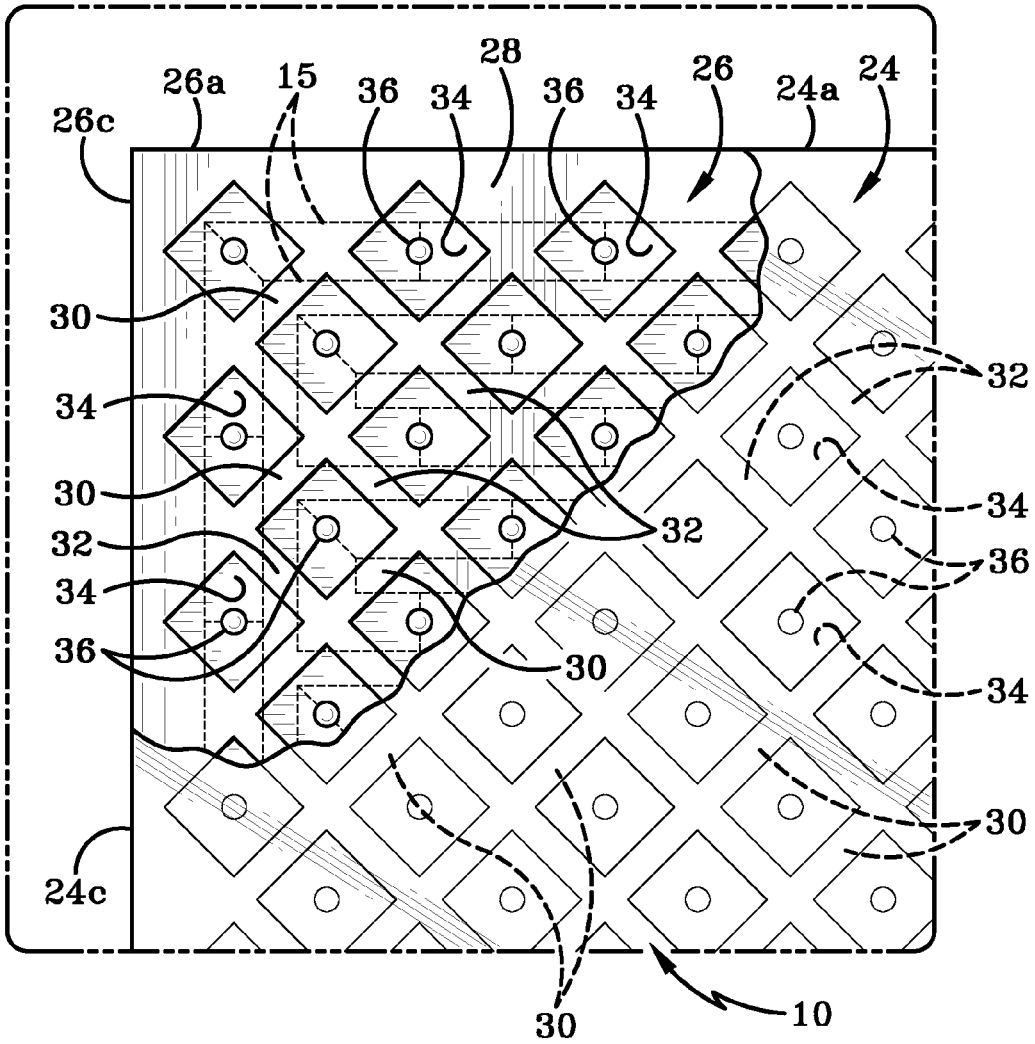
FIG. 5 is an enlarged top view of a highlighted corner region of the lighted work mat shown in FIG. 2, which corner includes a cut-away of the first layer of the work mat to show the components under that first layer.

First layer 24 has first and second edges 24*a*, 24*b* (FIG. 2) and first and second ends 24*c*, 24*d*. Second layer 26 has first and second edges 26*a*, 26*b* and first and second ends 26*c*, 26*d*. First and second edges 24*a*, 24*b* of first layer 24 and substantially vertically aligned with first and second edges 26*a*, 26*b*, respectively; and first and second ends 24*c*, 24*d* are substantially aligned with first and second ends 26*c*, 26*d*, respectively. As shown in FIG. 4, second layer 26 is disposed vertically beneath first layer 24 and thus second layer 26 is configured to rest upon surface 14 when work mat 10 is positioned beneath a vehicle.

First layer 24 preferably comprises a planar sheet of transparent or opaque material. First layer 24 preferably is a single solid sheet of material that extends substantially the entire length "L" (FIG. 2) and width "W" of work mat 10. It should be noted that preferably, the width "W" is configured to be smaller than the width of the undercarriage between the front or rear wheels of the vehicle 12 so that mat 10 may be easily inserted between these wheels.

Suitable materials for first layer 24 of the base include sheets of acrylic materials such as those sold under the trademark Plexiglas® fabricated by Arkema of Colombes, France, or gels that solidify into sheets of transparent or opaque material. The transparent or opaque nature of first layer 24 permits light 22 to pass through first layer 24 when switch 20 is activated, as will be hereinafter described. First layer 24 may be rigid or flexible in nature. The first layer 24 preferably is additionally of a sufficient strength and durability to withstand a mechanic's creeper or a vehicle rolling back and forth across the same multiple times.

Second layer 26 preferably is fabricated from materials such as rubber or plastic. Any other suitable material may be used without departing from the scope of the present invention. It will be understood that if second layer 26 is fabricated from plastic it may also be transparent or opaque so that light may shine therethrough. If this is the case then work mat 10 may be used with either of the first and second layers 24, 26 contacting surface 14.

Figure 2:
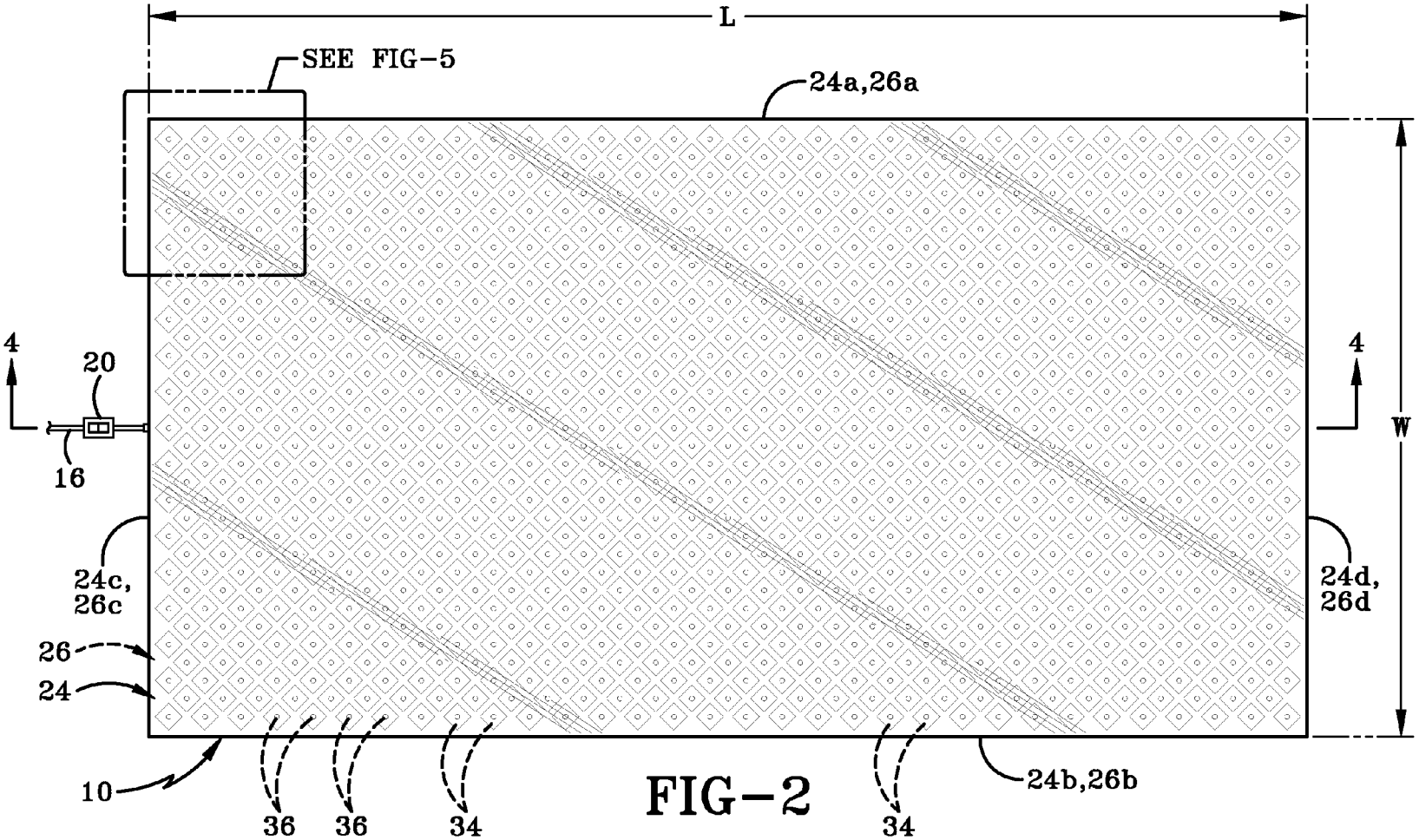
FIG. 2 is a top view of the lighted work mat in accordance with the present invention taken along line 2-2—of FIG. 1.
Figure 3:
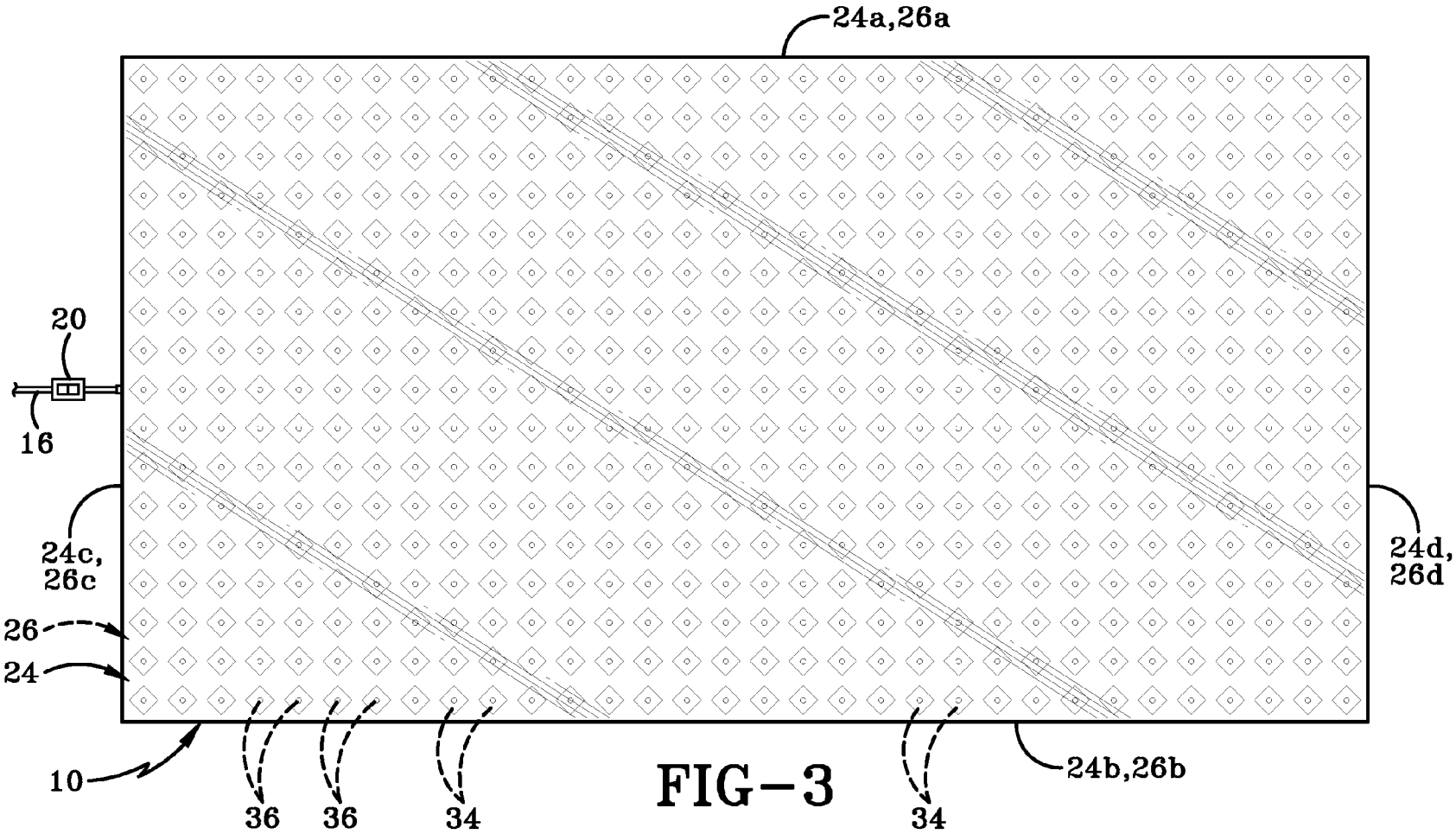
FIG. 3 is a top view of a second embodiment a lighted work mat in accordance with the present invention.

Second layer 26 may also be rigid or flexible in nature and of sufficient strength and durability to support the weight of a mechanic and a mechanic's creeper, or a vehicle. Second layer 26 includes a generally horizontal, planar region 28 that is disposed substantially parallel to first layer 24 and extends for substantially the entire length "L" and width "W" of work mat 10. Second layer 26 further includes a plurality of rows of upstanding first walls 30 and a plurality of rows of upstanding second walls 32. First walls 30 and second walls extend outwardly from region 28 and generally at right angles thereto. Furthermore, the rows of first walls 30 are spaced a distance apart from each other and are generally parallel to each other. The first walls 30 preferably as also disposed generally at 45 degrees to first and second edges 26*a*, 26*b* and first and second ends 26*c*, 26*d*. The rows of second walls 32 are spaced a distance apart from each other and are disposed parallel to each other. The rows of second walls 32 intersect the rows of first walls 30. The rows of second walls 32 are disposed at right angles to the rows of first walls 30 and are oriented generally at 45 degrees to first and second edges 26*a*, 26*b*, and first and second ends 26*c*, 26*d*. Thus, the rows of first and second walls 30, 32 form a grid that extends outwardly from region 28. As indicated in FIG. 2, the grid preferably is diamond shaped when viewed from above and the grid includes a first number of diamond-shapes. FIG. 3 shows a second embodiment of the lighted work mat that is constructed in substantially identical fashion to that of FIG. 2 except for the fact that the density of the diamond shaped region on the work mat is substantially lower than that of FIG. 3. (Consequently in the mat shown in FIG. 3, the number of light sources on the mat is less than in the mat shown in FIG. 2).

A plurality of compartments 34 is defined and bounded by portions of first layer 24, region 28 and pairs of adjacent first walls 30 and pairs of adjacent walls 32 in each of the mat shown in FIG. 2 and in FIG. 3.

In accordance with the present invention, work mat 10 includes a plurality of light sources which are embedded in the base. The light sources preferably are light emitting diodes (LEDs) 36. Each LED is located inside its own compartment 34 in the base. The wiring 15 extends through region 28 of second layer 26 and operatively connects the LEDs 36 to power cord 16. If first layer 24 is fabricated from a gel, the LEDs 36 will be installed on second layer 26 and connected to wiring 15 and the liquid gel material will be poured over second layer 26, covering the LEDs 36. Then, when the liquid gel material solidifies, the compartments 34 will be full of the solidified and hardened gel material and the LEDs 36 will be surrounded and covered by the solidified and hardened gel material. In either instance where first layer 24 is an acrylic sheet or a hardened gel layer, first layer 24 acts as a transparent shield for the LEDs 36.

Work mat 10 is used in the following manner. Vehicle 12 stands on surface 14. The mechanic will place second layer 26 of mat 10 on surface 14 and slide mat 10 underneath vehicle 12 in the manner represented by arrow "A" (FIG. 1). Cord 16 is plugged into outlet 18 and switch 20 is activated to cause electricity to flow through wiring 15, thereby causing LEDs 36 to light up. Light is therefore emitted by LEDs 36 and shines outwardly from mat 10 through first layer 24 (as represented by the rays 22 in FIG. 1). The rays 22 of light illuminated the undercarriage or underside 12*a* of vehicle 12 so that the mechanic is able to readily see the same.

Figure 6:
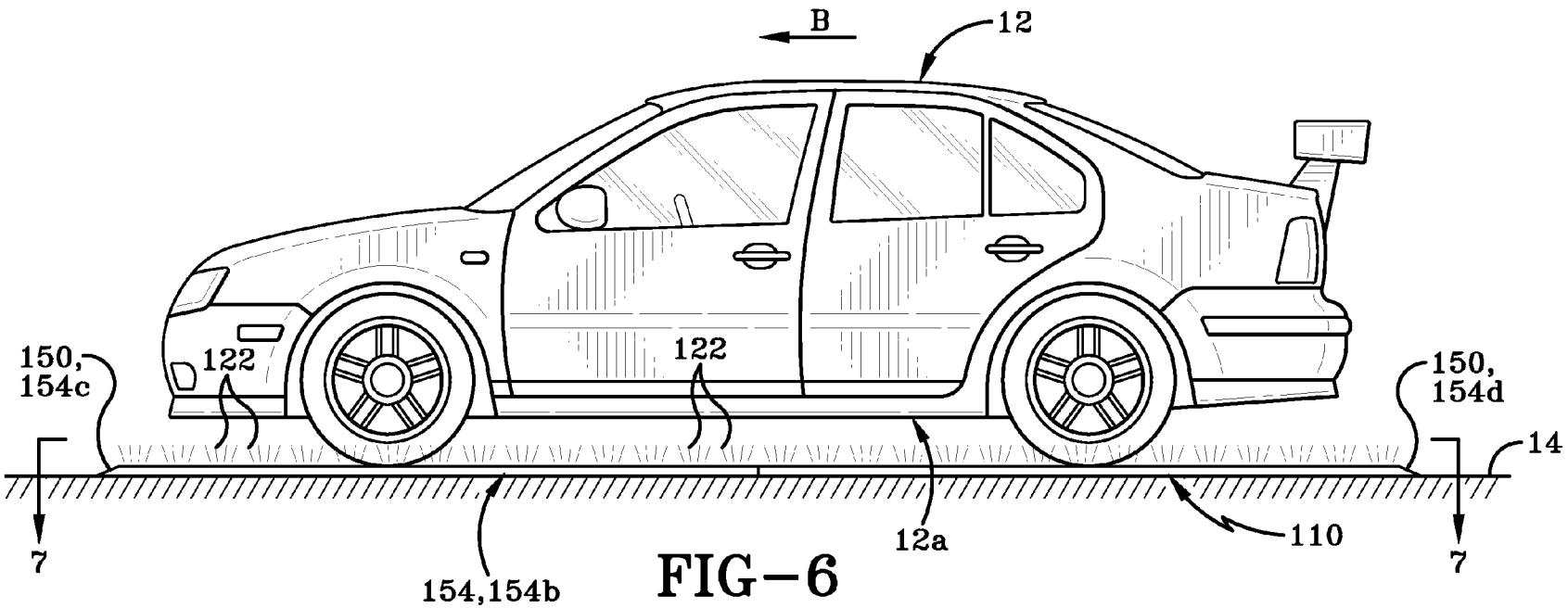
FIG. 6 is a side view of a lighted work mat comprising a plurality of modular panels, and which lighted work mat is of a sufficient size for a vehicle to rest upon the lighted work mat's upper surface.
Figure 7:
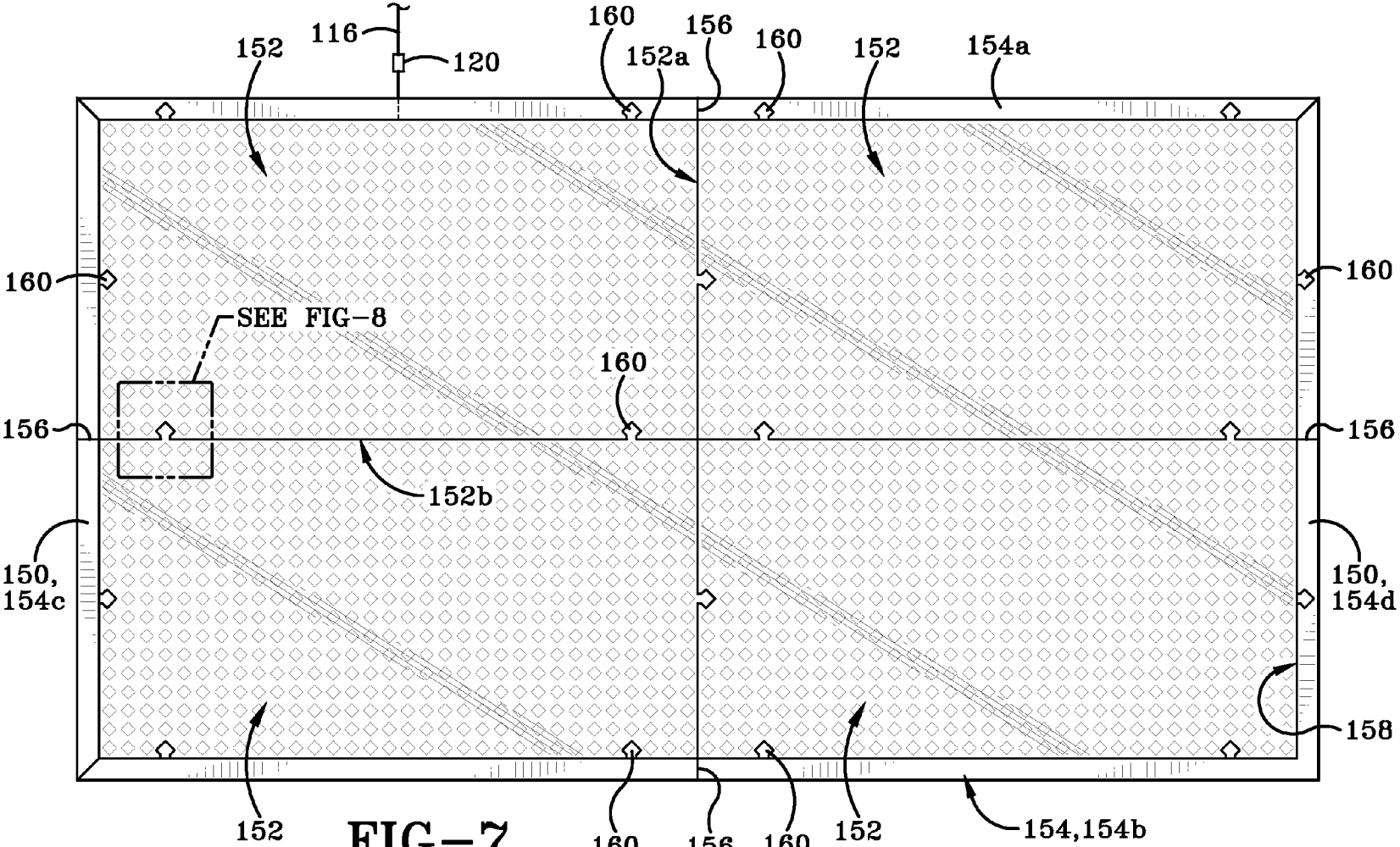
FIG. 7 is a top view of the lighted work mat of FIG. 6 showing the plurality of modular panels secured to each other.
Figure 8:
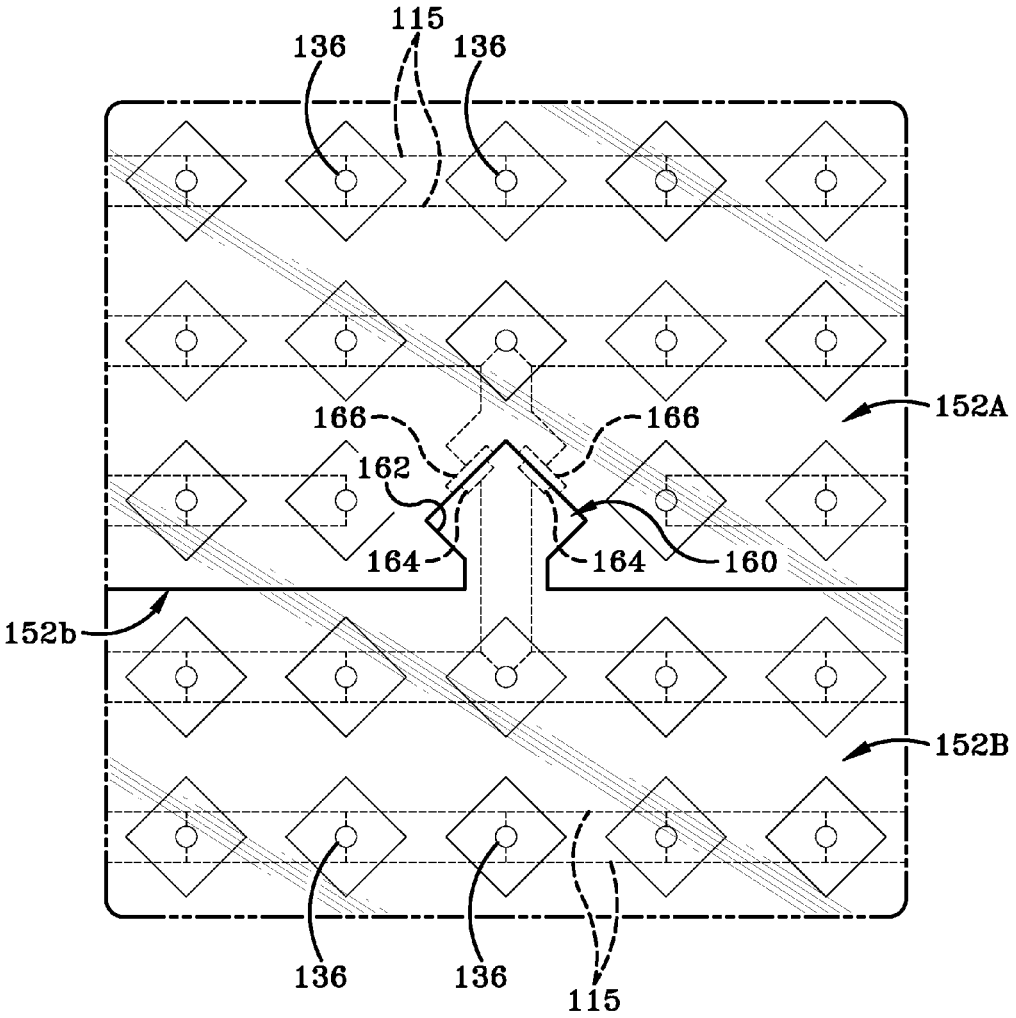
FIG. 8 is an enlarged top view of the lighted work mat of FIG. 7 showing the interlocking fastener mechanism which secures adjacent modular panels together.

FIGS. 6-8 show a second embodiment of a lighted work mat in accordance with the present invention, generally indicated at 110. Work mat 110 is configured for placement on a surface 14 in a similar manner to work mat 10 however, instead of being inserted under the undercarriage 12*a* of a vehicle 12 that is already standing on surface 14, work mat 110 is of a sufficient size that the vehicle 12 is able to be driven up one of two ramps 150 and onto an upper surface of work mat 110 as indicated by arrow "B" in FIG. 6. It will be understood that instead of work mat 110 comprising a separate mat that is placed on top of a surface 14, work mat 110 may be built into a recess in the surface. Consequently, work mat 110 may, for example, form part of a floor surface in a garage or the bed of a racing trailer. If work mat 110 is part of the floor surface of a garage or a bed of a racing trailer, the ramps 150 could be omitted from mat 110.

Referring to FIG. 7, work mat 110 preferably comprises a plurality of panels 152 that are inserted into a frame 154. Each of the panels 152 is fabricated to be substantially identical to work mat 10 with the exception that the panels 152 also preferably include fastener members for engaging to other similar panels 152. The fastener members will be hereinafter described.

Frame 154 preferably is a generally rectangular member that is made from a metal such as a heavy-duty steel. (It will be understood that frame 154 and therefore work mat 110 may be fabricated to any other desired shape. Frame 154 has a first edge 154*a*, a second edge 154*b*, a first end 154*c* and a second end 154*d* that are connected together to define and bound an interior cavity 158. One or more panels 152 are received in interior cavity 158 are engaged with frame 154. Each of the first and second edges 154*a*, 154*b* and first and second ends 154*c*, 154*d* of frame 154 is made from one or more metal bars. In FIG. 7, first edge 154*a*, for example, is made from two metal bars that are secured together at a joint 156 by any suitable means. For example, the two lengths of metal bar can be snap-fitted together or screwed together. In a similar fashion, second edge 154*b*, first end 154*c* and second end 154*d* are each comprised of two bars connected together at a joint 156. Although not illustrated herein it will be understood that frame 154 may also include a planar sheet of metal which will be disposed beneath lower surfaces of all of the interlocked panels 152.

In accordance with a specific feature of the present invention, frame 154 includes a plurality of fastener members 160 which extend into cavity 158. Each fastener member 160 is configured to be received within a complementary recess 162 defined in one of panels 152. In a similar fashion, each panel 152 has a perimeter made up from pairs of spaced-apart opposing edges 152*a*, 152 (FIG. 7). A first one of the pair of edges 152*a* includes a recess 162 and the second one of the pair of edges 152*a* includes a complementary fastener member 160. Similarly, a first one of the pair of edges 152*b* includes a recess 162 and the second one of the pair of edges 152*b* includes a complementary fastener member 160. These fastener member/recess 160, 162 combinations make it possible for the various panels 152 to be snap-fitted to each other and to frame 154. When all of the panels 152 are snap-fitted together and snap-fitted or interlockingly fitted into frame 154, the entire work mat 110 forms a substantially planar sheet that is able to be placed on a surface 14.

As shown in FIG. 8, in addition to the interlocking fastener members 160 and recesses 162 on panels 152, a first part 164 of a electrical contact is provided on a first panel 152A proximate the respective fastener member 160 and second part 166 of the electrical contact is provided on an adjacent second panel 152B proximate the respective recess 162. When the first and second panels 152A, 152B are interlocked, the first part 164 and second part 166 of the electric contact are united, closing the electrical circuit between the wiring 115 of the first and second panels 152A, 152B. Thus, when the switch 120 is activated, electricity flows through cord 116 from the remote power source (not shown) and lights up the LEDs 136 on both of the first and second panels 152A, 152B. The LEDs 136 emit light 122 (FIG. 6) which illuminates the underside 12*a* of the vehicle 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A work mat for a vehicle;

said work mat comprising:

a base;

a plurality of light sources embedded in the base;

wiring connecting the plurality of light sources together, said wiring being operatively connectable to a power source;

a frame;

a cavity defined by the frame, wherein the base is received within the cavity;

a fastening assembly which secures the base into the frame; and wherein the fastener assembly comprises a fastener member disposed on one of the frame and base; and a complementary recess defined on the other of the frame and the base; and wherein the fastener member is interlocking received within the recess to secure the base and frame together.

2. The work mat as defined in claim 1, wherein the light sources are light emitting diodes (LEDs).

3. The work mat as defined in claim 2, wherein the base comprises:

a first layer;

a second layer disposed vertically beneath the first layer; and wherein the LEDs are embedded between the first and second layers.

4. The work mat as defined in claim 3, wherein the second layer comprises:

a planar region that is disposed generally parallel to the first layer;

a set of first walls extending outwardly from a surface of the planar region opposite the first layer; and a set of second walls extending outwardly from the surface of the planar region; and wherein the sets of first and second walls extend between the planar region and a surface of the first layer.

5. The work mat as defined in claim 4, wherein the first and second walls extend outwardly from the planar region generally at right angles to the surface of the planar region from which they extend.

6. The work mat as defined in claim 5, wherein the set of first walls comprise a plurality of spaced apart parallel rows of first walls; and the set of second walls comprise a plurality of spaced apart parallel rows of second walls, and the second walls intersect the first walls generally at right angles.

7. The work mat as defined in claim 6, further comprising a plurality of compartments, wherein each compartment is defined and bounded by a portion of the planar region, a portion of the first layer; a portion of two adjacent rows of first walls, and a portion of two adjacent rows of second walls; and wherein each LED is housed in one of the plurality of compartments.

8. The work mat as defined in claim 3, wherein the first layer is fabricated from a first material and the second layer is fabricated from a second material.

9. The work mat as defined in claim 8, wherein the first layer comprises a substantially planar acrylic sheet.

10. The work mat as defined in claim 8, wherein the first layer comprises a gel that is applied over the second layer and surrounds the LEDs, and wherein the gel solidifies and hardens around the LEDs.

11. The work mat as defined in claim 3, wherein the second layer is fabricated from rubber or plastic.

12. The work mat as defined in claim 1, further comprising at least two bases with embedded light sources therein secured within the frame; and wherein the at least two bases are secured together and to the frame.

13. The work mat as defined in claim 12, further comprising one or more fastener assemblies for securing the two bases to each other and for securing the two bases to the frame; and wherein each fastener assembly includes a recess defined in the base or frame; and a complementary fastener member extending outwardly from the other base or frame; and the complementary fastener member is interlockingly engaged in the recess.

14. The work mat as defined in claim 1, further comprising a ramp provided adjacent one edge of the base.

15. A method of illuminating an undercarriage of a vehicle, said method comprising the steps of:

providing a work mat comprising a base; a plurality of light sources embedded in the base; wiring connecting the plurality of light sources together, wherein said wiring is operatively connectable to a power source; a frame; a cavity defined by the frame, wherein the base is received within the cavity; and a fastening assembly which secures the base into the frame, wherein the fastener assembly comprises a fastener member disposed on one of the frame and base; and a complementary recess defined on the other of the frame and the base; and wherein the fastener member is interlocking received within the recess to secure the base and frame together;

placing the work mat on a surface;

positioning the work mat beneath a portion of the undercarriage of the vehicle;

plugging an electrical cord on the work mat into the power source;

moving a switch from an inactive position to an active position to provide power to wiring within the work mat;

emitting light from the plurality of LED's embedded within the work mat and connected to the wiring; and positioning the work mat vertically beneath a desired region of the undercarriage of the vehicle so that the light emitted from the plurality of LED's shines onto the desired region of the undercarriage.

16. The method as defined in claim 15, wherein the step of positioning the work mat beneath a portion of the vehicle includes the step of:

driving the vehicle up a ramp at one end of the work mat and onto an upper surface of the work mat.

17. In combination:

a vehicle having an undercarriage;

a work mat comprising:

a base;

a plurality of light sources embedded in the base; and wiring connecting the plurality of light sources together; said wiring being operatively connectable to a power source;

a frame;

a cavity defined by the frame; and wherein the base is received within the cavity; and a fastening assembly which secures the base into the frame, wherein the fastener assembly comprises a fastener member disposed on one of the frame and base; and a complementary recesses defined on the other of the frame and the base; and wherein the fastener member is interlocking received within the recess to secure the base and frame together; and wherein the work mat is positionable beneath the vehicle's undercarriage and when the light sources are activated, the undercarriage is illuminated from below.

* * * * *